United States Patent [19]

Decker

[11] 4,316,723

[45] Feb. 23, 1982

[54] METHOD AND APPARATUS FOR SEVERING TUBE SECTIONS FROM TUBULAR WEBS AND TRANSPORTING SAME

[75] Inventor: Werner Decker, Ladbergen, Fed. Rep. of Germany

[73] Assignee: Windmöller & Hölscher, Lengerich, Fed. Rep. of Germany

[21] Appl. No.: 55,955

[22] Filed: Jul. 9, 1979

[30] Foreign Application Priority Data

Jul. 28, 1978 [DE] Fed. Rep. of Germany ..... 2833233

[51] Int. Cl.[3] ..... B65H 45/14

[52] U.S. Cl. ..... 493/419; 493/442

[58] Field of Search ..... 270/67, 68, 78, 83–85; 93/33 R, 33 H, 84 R, 84 TW

[56] References Cited

U.S. PATENT DOCUMENTS

| | | | |
|---|---|---|---|
| 2,022,351 | 11/1935 | Kahn | 270/68 R |
| 3,021,135 | 2/1962 | Joa | 270/78 |
| 3,632,103 | 1/1972 | Nikitits | 270/67 |
| 4,036,090 | 7/1977 | Feld | 270/31 |

*Primary Examiner*—Edgar S. Burr
*Assistant Examiner*—A. Heinz
*Attorney, Agent, or Firm*—Fleit & Jacobson

[57] ABSTRACT

The leading end of an intermittently fed flattened tubular web is clamped by a gripper, whereupon a severing mechanism cuts a section from the web. The gripper advances the leading end of the tube section before the trailing end has cleared a pair of clamping rollers and while a folding roller engages an intermediate portion of the section and moves it laterally to form a loop in the tube section before the latter is discharged transversely.

11 Claims, 3 Drawing Figures

METHOD AND APPARATUS FOR SEVERING TUBE SECTIONS FROM TUBULAR WEBS AND TRANSPORTING SAME

The invention relates to a method of severing tube sections intended for making bags from intermittently fed tubular webs and transporting same in loop form and transverse position to base forming machines, and to an apparatus for performing this method.

In an apparatus of this kind known from DE-PS No. 19 24 109, the tube sections severed from a tubular web are fed transversely to a central rising tube so that the depending sides of the tube section can be engaged by grippers. Only after the grippers have engaged the tube section is the loop released from the tube so that the loop is formed downwardly by being suspended. At the ends of the tube section projecting beyond the grippers, the bases can be formed independently of the particular length of the tube section but the known apparatus has the disadvantage that complicated and expensive guides are required which nevertheless fail to guide the tube section sufficiently exactly to avoid the need for subsequently cutting the edges of the sack section by means of trimming knives to arrive at the desired size.

It is therefore the problem of the present invention to provide a method of the aforementioned kind by which the tube sections can be simply placed in loops with the edges accurately aligned without expensive conveying and guiding means.

According to the invention, this problem is solved in that the leading edge of the tubular web is clamped tight and the tube section is severed therefrom behind the clamping position at the spacing of the desired severed length, the trailing end of the section is folded thereon while forming a loop, and its rear edge region disposed at a spacing from the clamping position is pressed against a conveyor moving under the section for the purpose of conveying the tube section in a transverse position after it has been released. According to the method of the invention, subsequent trimming of the tube sections severed from the tubular web is unnecessary because they are already clamped tight in the correct position before they are severed from the tubular web. Loop formation is effected in a simple manner in that the tube section clamped tight at its leading end is drawn off the conveyor by a rod forming the loop. Tube sections of different length can be treated in the same base forming machines because only a larger or smaller loop is formed depending on the length of the section. The looped tube sections are discharged in that they are for example pressed by pressure rollers against a circulating conveyor which leads them in the correct position to the base-forming machine. The trailing edge of the tube section folded according to the method of the invention terminates at such a spacing in front of its leading edge that a sufficiently wide strip is formed for pulling the base open and folding same.

An apparatus for performing the method of the invention comprising conveyors intermittently feeding the tubular web and severing means interposed in the conveying path is characterised according to the invention in that, behind the end of the last conveyor of the conveying path, grippers are provided which are displaceable in the conveying direction of the tubular web and which receive and clamp the leading web end, that a cantilever mounted rod can be moved into the gap between the gripper and the conveyor to pull the severed web section from the conveyor while forming a loop, and that beneath the portion of the section laid into a loop there is a conveyor which conveys transversely to the conveying direction of the tubular web and against which pressure rollers can be applied which, in their rest position, are disposed above the looped rear end of the section. As soon as the leading edge of the web leaves the last conveyor, it enters the opened gripper of which the opening and closing movements are desirably controlled by cam plates. Depending on the desired sack length or rather the width required for forming the base, the gripper subsequently pulls the leading edge of the tubular web forwardly. Particularly long sacks can also be made in that the severing means cut the tube section from the web only when the loop-forming rod has already entered the gap between the gripper and the conveyor for forming the loop. Since the rod forming the loop is cantilever mounted, the section formed with a looped fold can be discharged by easily pulling it over the free end of the rod.

In a development of the invention, a plurality of grippers is secured to circulating endless chains. This construction permits a new gripper to be moved to its receiving position while the preceding gripper is still advancing the web or the section just severed from it. Whilst the looped section is being taken away, the leading edge of the web can thus already enter the next gripper. This construction of the apparatus according to the invention permits the structural length of the machine to be very short.

Desirably, a plurality of rods is secured to parallel chains moving at a spacing from each other so that they can continuously enter the gap between the grippers and the conveyor for the purpose of loop formation. The rods are desirably provided with a rotatable cover or they are in the form of rotatable rollers so that they need not slide on the section during loop formation.

The last conveyor can consist of a clamping roller pair which can be uncoupled from its drive and from which the rear end of the section is pulled out during loop formation.

To permit a good formation of the loop, the clamping roller pair may be displaceable to and fro in the conveying direction and also raisable and lowerable. For this purpose special cam-controlled drives may be provided.

The grippers are desirably moved above a table plate and parallel thereto so that the end of the section serving for folding the base can be taken away transversely to the base forming machine while resting on the section.

Desirably, a transversely conveying conveyor belt is provided which is arranged below the table plate and parallel to the rods and against which the pressure rollers can be applied. The transversely conveying conveyor belt thus lies closely beneath the plane which is stretched during loop formation from the leading portion of the section. Instead of the pressure rollers, other pressure means may also be provided, for example a pressure belt. During loop formation, the section is desirably withdrawn from the rods substantially vertically downwardly or at an acute angle to the vertical.

An example of the invention will now be described in more detail with reference to the drawing, wherein.

Figure 1:
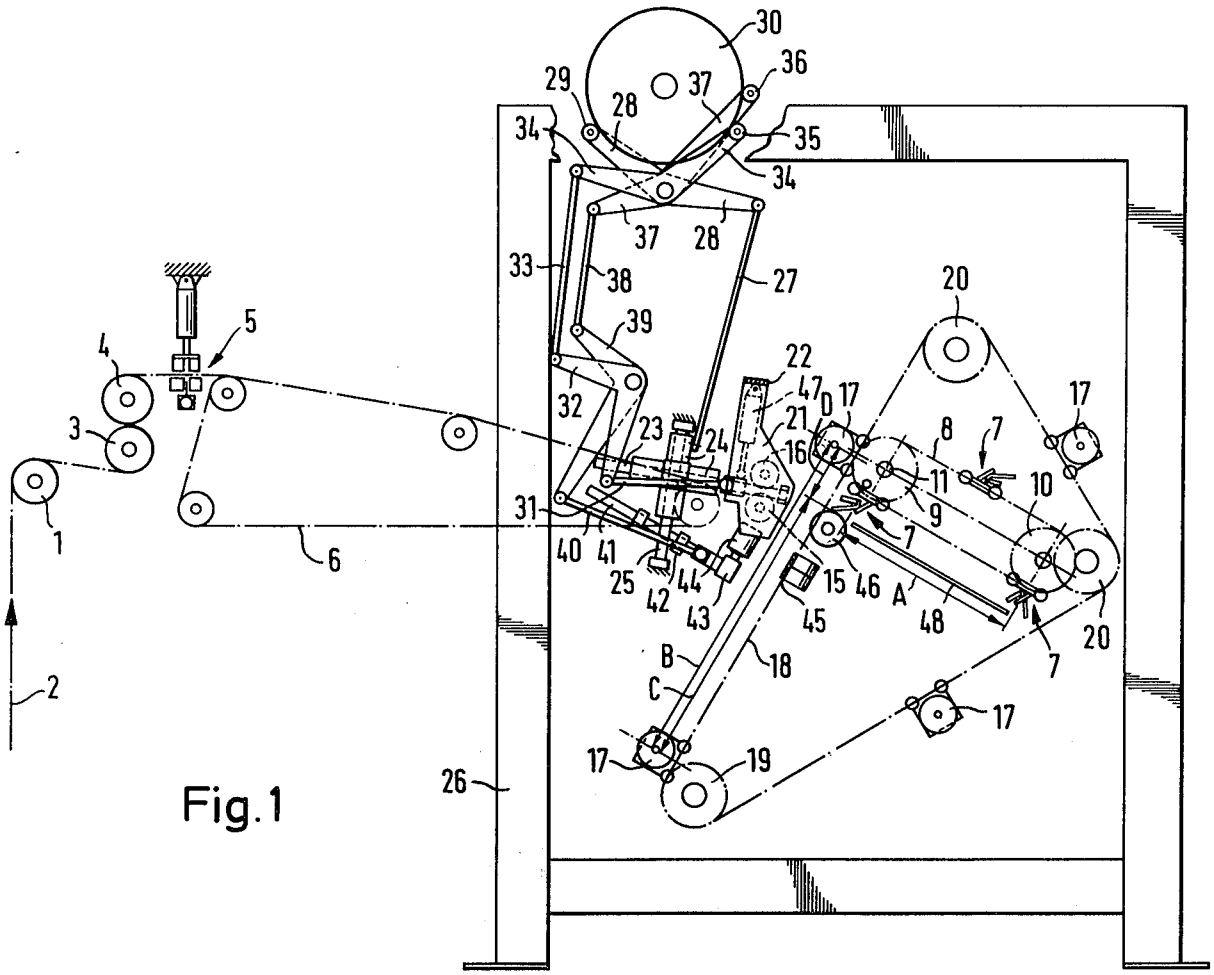
FIG. 1 is a diagrammatic side elevation of the apparatus for severing the tube sections and for loop formation.

A flattened tubular web 2 is fed over a direction-changing roller 1 to feed rollers 3 and 4. By way of these feed rollers 3, 4, which advance the web 2, the flattened tubular web 2 first reaches cutting means 5 through which the web first passes.

The leading edge of the web 2 provided with a transverse cut at its leading end reaches the opened mouth of a gripper 7 by way of a belt conveyor 6. As soon as the gripper 7 has engaged the leading edge of the web 2, the cutting means 5 sever the web 2 so that a tube section is formed. In order that different tube section lengths can be obtained, the spacing between the cutting tool and the gripping tool 7 is adjustable. Thus, to form tube sections the web is first passed through the open cutting means 5 into the open mouth of the gripping tools 7 so that no individual tube sections are conveyed through the belt conveyor 6 but the web is only severed when the leading end of the arriving web has been engaged by the mouth of the gripper 7.

Since this machine is a cyclic machine, the belt conveyor as well as the feed rollers are stopped as soon as the open mouth of the gripper 7 has engaged the leading end of the web of sacks. The belt conveyor 6 has a slightly higher speed than the feed rollers 3 and 4 so as to pull taut each leading web end that is to be transported. Stopping the feed or the feed rollers 3 and 4 can be effected in known manner by way of photocells or change gearing.

The grippers themselves are mounted on a chain 8 at a fixed constant spacing from each other, the chain 8 being driven by sprockets 9 and diverted at 10. After the leading tube end or the leading tube edge has entered the open mouth of a gripper 7, this gripper must be closed. For this purpose, a cam plate 12 is provided on the shaft 11 which also supports the sprocket or sprockets 9. This cam plate 12 is rotatably mounted on the shaft 11 and is turned by a pneumatic piston-cylinder unit 13. During this rotation, a roller 14 runs on the cam plate 12 and, in a manner not described in more detail, closes the open mouth of the gripper 7 that is disposed in the operative position. Thereafter, a tube section is cut off by the severing means 5. The drive for the chain 8 is then switched on and the gripper which has clamped the tube section in its mouth moves from the left-hand position in FIG. 1 through distance A to the right-hand position of FIG. 1. During this interval, the front brake and feed rollers 15 and 16 are idling, i.e. they are neither driven nor braked.

While the gripper 7 is moving from its left-hand to its right-hand position, a roller 17 is simultaneously moved through the gap between the direction-changing roller 46 and the brake and feed rollers 15 and 16. This roller 17 is secured to a further chain conveyor 18 which consists of two spaced and parallel chains and which can be operated by way of the drive 19 and the direction-changing sprockets 20. As shown in FIG. 1, a plurality of rollers 17 are provided on the chains 18. During transport of the roller 17 through the distance designated B to its lower position, the roller 17 presses the tube section downwardly and thereby forms a loop because one end of the tube section has been engaged by the gripper 7 and the other end of the tube section is still trailing to a larger or smaller extent behind the brake and feed rollers 15 and 16. Just before reaching the final position of the roller 17, the rollers 15 and 16 are braked and hold the rear end of the tube section tight.

The two brake and drive rollers 15 and 16 are mounted in two sheet metal plates 21 interconnected by a cross-member 22. Guide rods 23 connected to the plates 21 are held by a guide 24. These guides 24 are in turn reciprocatable on a guide rod 25 which is fixed to the frame 26. This displacement, i.e. reciprocating movement, of the guide sleeve 24 is effected by way of a pull rod 27 which is reciprocated by means of a cam plate 30 by way of a bell crank lever 28 and a roller 29. The roller 29 is for example held in contact with the cam plate 30 by means of a tension spring.

The plates 21 are also engaged by two pull rods 31 which can be reciprocated by way of a bell crank lever 32, a pull rod 33 and a further bell crank lever 34 by way of a roller 35 by means of the cam plate 30. This cam plate 30 is provided with different guide tracks, i.e. it can be divided into two, so that the roller 29 runs on a first track and the roller 35 on a second track.

A further roller 36 rolls on a third cam track, the roller 36 being mounted on a bell crank lever 37 of which the free end is connected to a pull rod 38 and the latter is in turn connected to a further bell crank lever 39. Apart from the pull rod 38, the bell crank lever 39 has a further pull rod 40 which engages a guide rod 41 mounted on stationary guides 42. At its end facing the folded tube section, the guide rod 41 has a mounting 43 which carries several pressure rollers 44. A conveyor belt 45 is mounted opposite these pressure rollers 44. After the loop has been formed, the pressure rollers 44 are pressed against the conveyor belt 45, the mouth of the gripper 7 is opened, the rollers 15 and 16 are moved apart and the folded tube section is then transported laterally out of the machine by switching on the belt drive. However, before discharge takes place, the following steps are necessary.

The sheet metal plates 21 and thus the drive and brake rollers 15 and 16 are moved substantially in the direction towards the direction-changing roller 46 by operating the pull rods 27 and 31. The rollers 15 and 16 are thereafter moved apart so that the end of the tube section is no longer held therebetween. This takes place by way of a pneumatic piston-cylinder unit 47. Thereafter the separated rollers 15 and 16 are moved upwardly by further operation of the pull rod 27 so that the end of the tube section that is still disposed between the rollers 15 and 16 is pulled out and erected. These movements must be so adapted to one another that the end that has been withdrawn from the rollers 15 and 16 and erected by reason of the movement of these rollers is not so high that it impedes the entry of the arriving tubular web into the next gripper 7, i.e. the rollers 15 and 16 returned to the basic position by the pull rods 27 and 31 convey the newly arriving end of the tubular web into a second gripper brought to the operative position while the folded tube section is still being laterally discharged from the machine. For this purpose, the rollers 44 are, as already mentioned, pressed against the belt conveyor 45 by way of the pull rod 38 and they thus squeeze the folded tube section between each other. In order that the rollers 15 and 16 can operate as feed rollers in the first place, these rollers are coupled to the drive of the feed rollers 3 and 4, for example by way of an electromagnetic clutch.

As previously mentioned, the spacing between the gripper in the operative position and the cutting means can be changed by displacement of the latter for the purpose of setting different tube section lengths. Similarly, the effective path C must of course be changed for each loop-forming roller 17. For this purpose the entire chain 18 is advanced or retracted by way of differential gearing (not shown) so that the distance D is changed accordingly. This distance D represents the idling distance for each loop-forming roller 17 before it makes contact with the loop web.

The folded tubular sack section leaving this apparatus laterally then arrives at a base forming station. The base is folded at this station. The amount of material of the folded tube section necessary for forming a base is the portion of the tube section that is disposed on the table plate 48 in FIG. 1. Now, if one wishes to obtain different base widths, it is necessary to change the length of this portion of the tube section. This is achieved in that the gripper is not only moved through the distance A from its left-hand position in FIG. 1 to the right-hand position shown in FIG. 1. Instead, the gripper is moved through a desired longer or shorter distance beyond the table plate 48. For this purpose the normal drive for the chain 8 has a further drive superimposed on it that is so operated that the basic position of a gripper in the position where the leading tubular web end is engaged is always the same while the rear limiting position is variable. A superposed motion thus takes place here. With a given length of section, the distance B must then of course also be changed accordingly.

Figure 2:
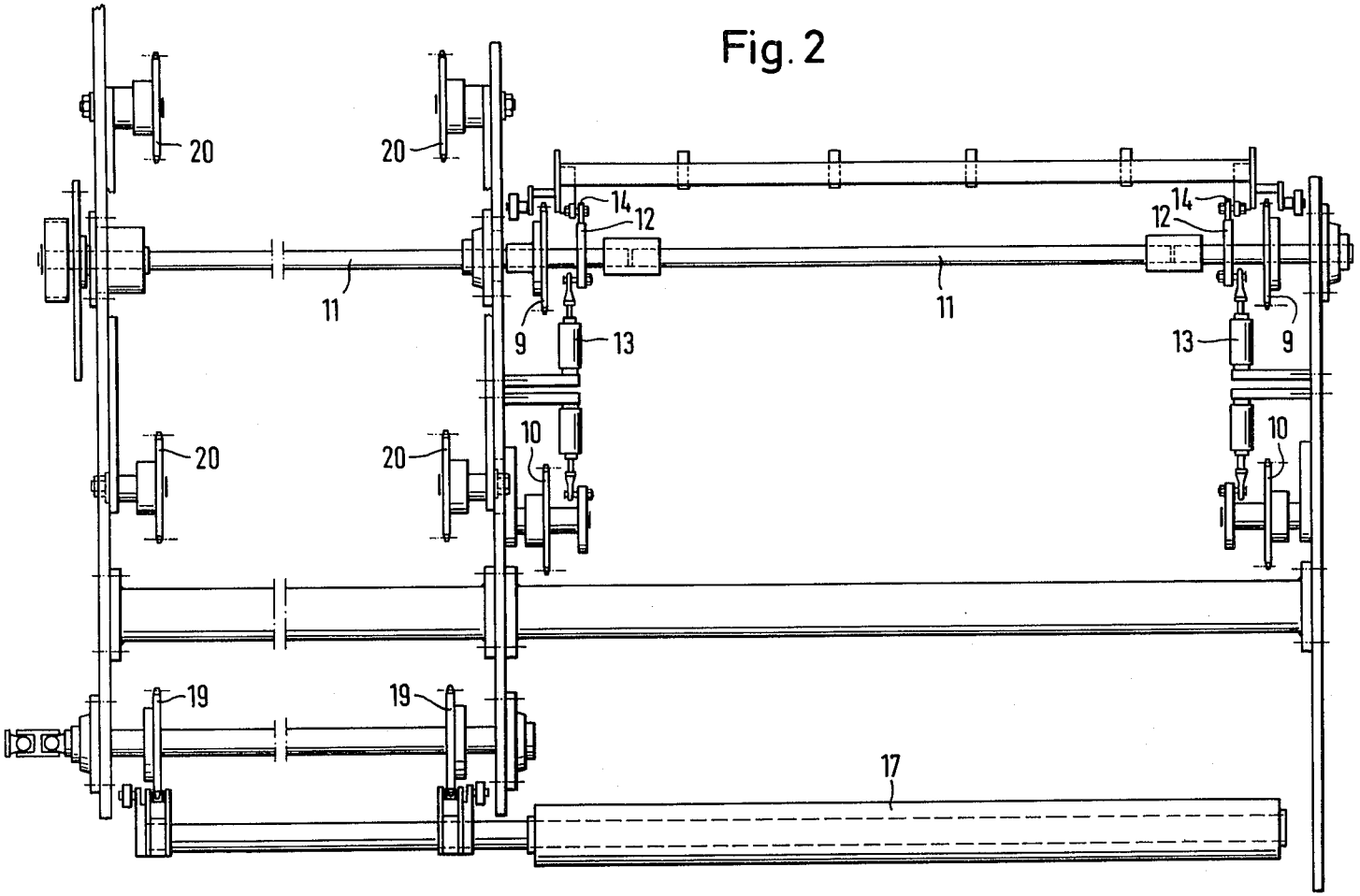
FIG. 2 is a section through the folding tools.
Figure 3:
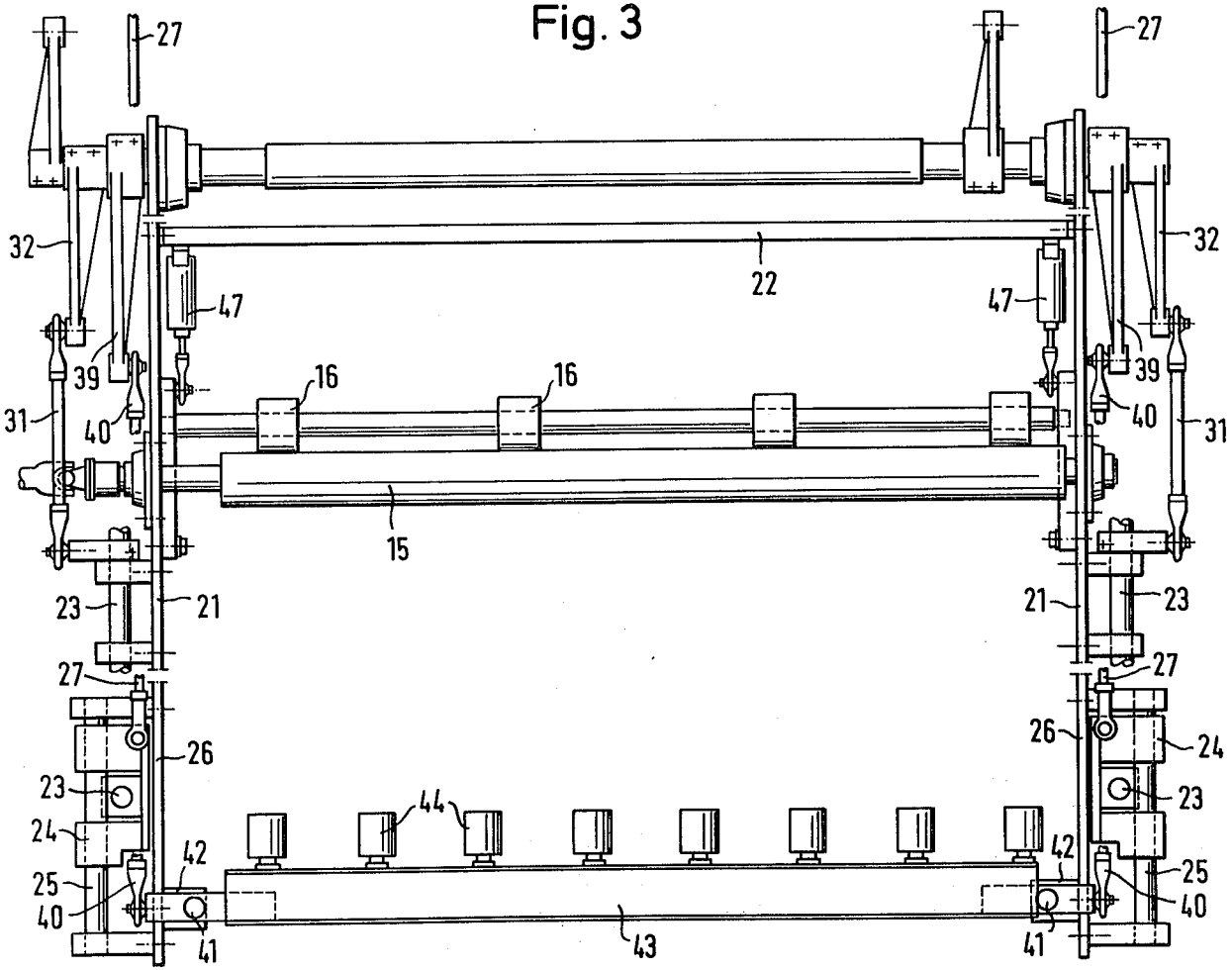
FIG. 3 is a section through the pressure means for transversely conveying the folded sack.

In order that the folded tube section may be laterally withdrawn from the apparatus according to the invention, the loop-forming rollers 17 are cantilever mounted as shown in FIG. 2. To avoid friction between the individual rollers 17 and the film during lateral withdrawal, the drive of the feed rollers 15 and 16 is operated so that slight play exists between the feed rollers 15 and 16 and the lower loop-forming roller 17.

To avoid excessive acceleration or excessive braking in the apparatus according to the invention, provision is made for appropriate superimposed gearing (not shown).

I claim:

1. An apparatus for severing tube sections from intermittently fed tubular webs and for conveying severed tube sections in loop form with leading and trailing edges of the tube sections positioned on opposite sides of the loop, said apparatus comprising:

first conveying means for intermittently feeding a tubular web in a feeding direction, said first conveying means defining a web conveying plane and having a downstream end positioned at a first level;

severing means interposed in the conveying plane defined by the first conveying means for severing a tube section from the web;

gripping means comprising a circulating endless chain and a plurality of grippers secured to said chain, said gripping means being positioned after a downstream end of the first conveying means, in the feeding direction, for receiving and gripping a leading edge of the web, there being a gap between said first conveying means and said gripping means;

means for displacing said gripping means in the feeding direction;

loop forming means disposed in said gap for movement between a first position above the conveying plane and a second position below the conveying plane for contacting a portion of the severed tube section intermediate the leading and trailing edges, for pulling the tube section from the first conveying means, and for forming a loop in the intermediate portion of the severed tube section;

second conveying means positioned at a level lower than the level of the downstream end of the first conveying means and running transversely to the web feeding direction for contacting a side of the loop formed by said loop forming means facing said second conveying means; and movable pressure means for pressing the loop against said second conveying means, said movable pressure means being positioned to contact a side of the loop opposite the side facing the second conveying means and being movable to apply the loop to said second conveying means so that the severed tube section is conveyed transversely to the web feeding direction with leading and trailing edges of the section on opposite sides of the loop.

2. An apparatus for severing tube sections from intermittently fed tubular webs and for conveying severed tube sections in loop form with leading and trailing edges of the tube sections positioned on opposite sides of the loop, said apparatus comprising:

first conveying means for intermittently feeding a tubular web in a feeding direction, said first conveying means defining a web conveying plane and having a downstream end positioned at a first level;

severing means interposed in the conveying plane defined by the first conveying means for severing a tube section from the web;

gripping means positioned after a downstream end of the first conveying means, in the feeding direction, for receiving and gripping a leading edge of the web, there being a gap between said first conveying means and said gripping means;

means for displacing said gripping means in the feeding direction;

loop forming means disposed in said gap for movement between a first position above the conveying plane and a second position below the conveying plane for contacting a portion of the severed tube section intermediate the leading and trailing edges, for pulling the tube section from the first conveying means, and for forming a loop in the intermediate portion of the severed tube section, said loop forming means comprising parallel chains spaced from each other by a distance greater than the width of the web, and a plurality of spaced apart rods secured to said chains, said chains having runs such that said rods pass through said gap to form said loops;

second conveying means positioned at a level lower than the level of the downstream end of the first conveying means and running transversely to the web feeding direction for contacting a side of the loop formed by said loop forming means facing said second conveying means; and movable pressure means for pressing the loop against said second conveying means, said movable pressure means being positioned to contact a side of the loop opposite the side facing the second conveying means and being movable to apply the loop to said second conveying means so that the severed tube section is conveyed transversely to the web feeding direction with leading and trailing edges of the section on opposite sides of the loop.

3. An apparatus for severing tube sections from intermittently fed tubular webs and for conveying severed tube sections in loop form with leading and trailing edges of the tube sections positioned on opposite sides of the loop, said apparatus comprising:

first conveying means for intermittently feeding a tubular web in a feeding direction, said first conveying means defining a web conveying plane and having a downstream end positioned at a first level, said first conveying means comprising a first driven conveyor, and a clamping roller pair having a driven roller that can be selectively uncoupled from its drive, said clamping roller pair being displaceable to and fro in the feeding direction and being raisable and lowerable as a unit;

severing means interposed in the conveying plane defined by the first conveying means for severing a tube section from the web;

gripping means positioned after a downstream end of the first conveying means, in the feeding direction, for receiving and gripping a leading edge of the web, there being a gap between said first conveying means and said gripping means;

means for displacing said gripping means in the feeding direction;

loop forming means disposed in said gap for movement between a first position above the conveying plane and a second position below the conveying plane for contacting a portion of the severed tube section intermediate the leading and trailing edges, for pulling the tube section from the first conveying means, and for forming a loop in the intermediate portion of the severed tube section;

second conveying means positioned at a level lower than the level of the downstream end of the first conveying means and running transversely to the web feeding direction for contacting a side of the loop formed by said loop forming means facing said second conveying means; and movable pressure means for pressing the loop against said second conveying means, said movable pressure means being positioned to contact a side of the loop opposite the side facing the second conveying means and being movable to apply the loop to said second conveying means so that the severed tube section is conveyed transversely to the web feeding direction with leading and trailing edges of the section on opposite sides of the loop.

4. An apparatus according to claim 1, 2 or 3 wherein said gripping means comprises a circulating endless chain and a plurality of grippers secured to said chain.

5. An apparatus according to claim 1, wherein said loop forming means comprises parallel chains spaced from each other by a distance greater than the width of the web, and a plurality of spaced apart rods secured to said chains, said chains having runs such that said rods pass through said gap to form said loops.

6. An apparatus according to claim 1 or 2, wherein said first conveying means comprises a first driven conveyor, and a clamping roller pair having a driven roller that can be selectively uncoupled from its drive.

7. An apparatus according to claim 6, wherein said clamping roller pair are displaceable to and fro in the feeding direction and are raisable and lowerable as a unit.

8. An apparatus according to claim 7, wherein one of the rollers of said clamping roller pair is movable away from the other.

9. An apparatus according to claim 1, 2 or 3 further comprising a table plate positioned to receive and support thereon a leading edge portion of the severed tube section during conveying by said second conveying means.

10. An apparatus according to claim 1, 2 or 3 wherein said movable pressure means comprises a plurality of spaced apart rollers having axes parallel to a conveying plane defined by said second conveying means.

11. An apparatus according to claim 1, 2 or 3 wherein said first conveying means defines a generally horizontal conveying plane, and said second conveying means defines a generally vertical conveying plane.

* * * * *